United States Patent [19]

Helfman

[11] 4,437,273

[45] Mar. 20, 1984

[54] TRUSS CONSTRUCTION

[76] Inventor: Robert Helfman, Brighton, Mich. 48116

[21] Appl. No.: 278,726

[22] Filed: Jun. 29, 1981

Related U.S. Application Data

[63] Continuation-in-part of Ser. No. 254,535, Apr. 15, 1981.

[51] Int. Cl.[3] ..... E04B 7/02

[52] U.S. Cl. ..... 52/93; 52/643

[58] Field of Search ..... 52/93, 639, 643, 92

[56] References Cited

U.S. PATENT DOCUMENTS

| | | | |
|---|---|---|---|
| 2,541,784 | 2/1951 | Shannon | 103/1 |
| 2,762,084 | 9/1956 | Sirger | 52/643 X |
| 3,352,082 | 11/1967 | Dickinson | 52/639 |
| 3,783,563 | 1/1974 | Moore | 52/11 |
| 3,881,286 | 5/1975 | Smith et al. | 52/90 |
| 3,999,338 | 12/1976 | Behan, Jr. et al. | 52/92 |
| 4,005,556 | 2/1977 | Tuomi | 52/93 |
| 4,096,670 | 6/1978 | Fuller | 52/90 |
| 4,274,234 | 6/1981 | Abell | 52/93 X |

*Primary Examiner*—Carl D. Friedman

*Attorney, Agent, or Firm*—Gifford, VanOphem, Sheridan, Sprinkle & Nabozny

[57] ABSTRACT

A unique truss is provided for constructing the upper level of a dwelling in which a predetermined number of trusses are aligned in a parallel but spaced apart relationship to each other. The truss comprises an elongated floor joist having an outer wall framing member extending upwardly from each of its ends so that the outer wall framing members are parallel to each other. A peaked roof support then extends between and is secured to the upper end of the outer wall framing members. A horizontally extending ceiling member is then secured to the roof support at a position intermediate its ends so that the ceiling member is spaced upwardly from the floor joist by a distance equal to a conventional room height. At least one inner wall member is then secured between the floor joist and the roof support at a position spaced inwardly from the outer wall framing member. The floor joist are then supported at their outer periphery by the walls of a lower foundation whereupon the trusses together form the entire frame for the upper level of the dwelling.

4 Claims, 5 Drawing Figures

TRUSS CONSTRUCTION

CROSS REFERENCE TO RELATED APPLICATIONS

This application is a continuation-in-part of my patent application entitled "Residential Building Construction" filed on Apr. 15, 1981 and assigned Ser. No. 254,535.

BACKGROUND OF THE INVENTION

I. Field of the Invention

The present invention relates generally to building constructions and, more particularly, to a unique truss construction for the upper level of a home or other dwelling.

II. Description of the Prior Art

In building constructions, and particularly single family dwellings, the building is constructed by assembling a plurality of framing members, typically wooden studs, together to form the housing frame. At the same time, the interior walls of the dwelling are individually assembled by carpenters and attached to the dwelling frame as required. After the frame walls have been constructed in this fashion, the roof joists are attached to and across the top of the frame walls to complete the construction of the frame for the dwelling. In addition, oftentimes, the roof joists are constructed from prefabricated trusses.

A primary disadvantage of constructing the dwelling frame in this fashion is that each wooden stud must be individually cut to size and individually secured together to the other studs to form the frame. Consequently, this previously known method is very time-consuming and very expensive in terms of labor costs. Furthermore, since the wooden studs for the frame are individually cut to size and secured together, workmen errors sometimes occur which require time-consuming and expensive correction before the building construction can be completed.

SUMMARY OF THE PRESENT INVENTION

The present invention overcomes the above-mentioned disadvantages of constructing a building or dwelling frame by providing a truss system for constructing the entire upper level of the frame from prefabricated trusses.

In brief, the truss system according to the present invention comprises a predetermined number of trusses aligned with each other in a parallel but spaced apart relationship. Each truss includes an elongated floor joist and have a pair of elongated outer wall framing members or studs attached to and extending upwardly from each end of the floor joist. The outer wall studs are parallel to each other and have a height or length substantially one half the height of a conventional living space.

A peak roof support then extends between and is secured to the upper ends of the outer wall studs. In addition, a horizontally extending ceiling stud is secured to the roof support at a position intermediate its ends so that the ceiling stud is spaced upwardly from the floor joist by the height of a conventional living space. In addition, in the preferred form of the invention, both the ceiling stud and floor joist are centered about the roof peak.

A vertically extending inner wall stud is secured between the floor joist and the roof support at a position spaced inwardly from at least one, and preferably both, outer wall studs. The space between the inner and outer wall studs is less than the height of a conventional living space and, preferably, a cross brace extends diagonally between these studs to increase the rigidity and strength of the overall truss.

After the trusses have been constructed, they are positioned on a lower foundation so that the trusses are spaced apart and parallel to each other. In doing so, the ceiling studs are aligned with each other and thus form the required frame for the ceiling. Simultaneously, the inner wall studs are aligned with each other and form the frame for the inner walls of the dwelling and, likewise, the roof support and floor joists form the frame work for the roof and floor, respectively.

Each truss according to the present invention is advantageously prefabricated at a factory or other manufacturing location and then transported to the building site. At the building site, the trusses are simply mounted upon the foundation walls and secured in place to form the frames for the entire upper level of the dwelling. Thus, the trusses according to the present invention eliminates the previously known necessity of individually cutting each stud and then securing the studs together at the building site as well as the time and labor cost required to do this. Furthermore, since each truss can be rapidly constructed at the factory with greater precision than is obtainable at the building site, workmen errors in constructing the building frame are virtually eliminated.

In the preferred form of the invention, the entire frame for the upper building level is constructed from a limited number, for example three, of different trusses. For example, two trusses would differ from each other only by the space between the inner and outer wall studs to provide a recessed wall for a closet or the like. Similarly, the overall truss system preferably includes a third truss with shortened floor joists to provide access for a stairwell to the upper living level.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
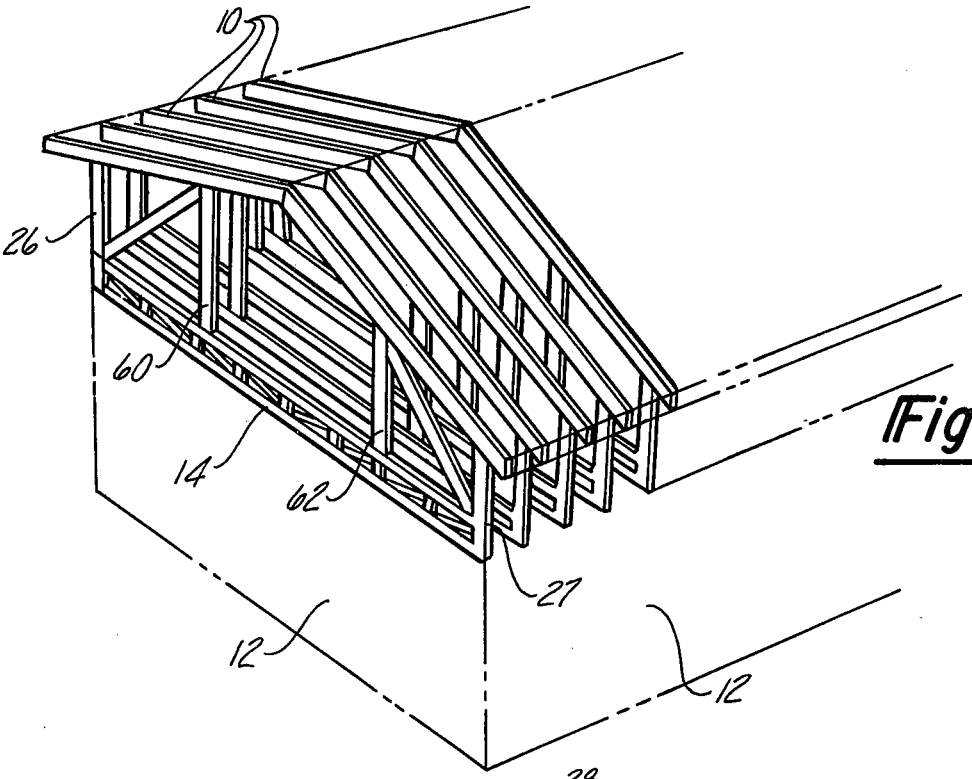
FIG. 1 is an elevational view illustrating a preferred embodiment of the truss system of the present invention.

With reference first to FIG. 1, a view of a preferred embodiment of the truss system according to the present invention is thereshown and comprises a plurality of trusses 10 which are arranged in a spaced apart and parallel relationship relative to each other. The trusses 10, which will be subsequently described in greater detail, are supported around their outer periphery by foundation walls 12 which can be constructed for any conventional material, such as wooden framing members, concrete, or the like. The foundation walls 12 define the living space for a lower level of the dwelling and, if desired, can be partially subterrainian as described in my copending patent application.

Figure 2:
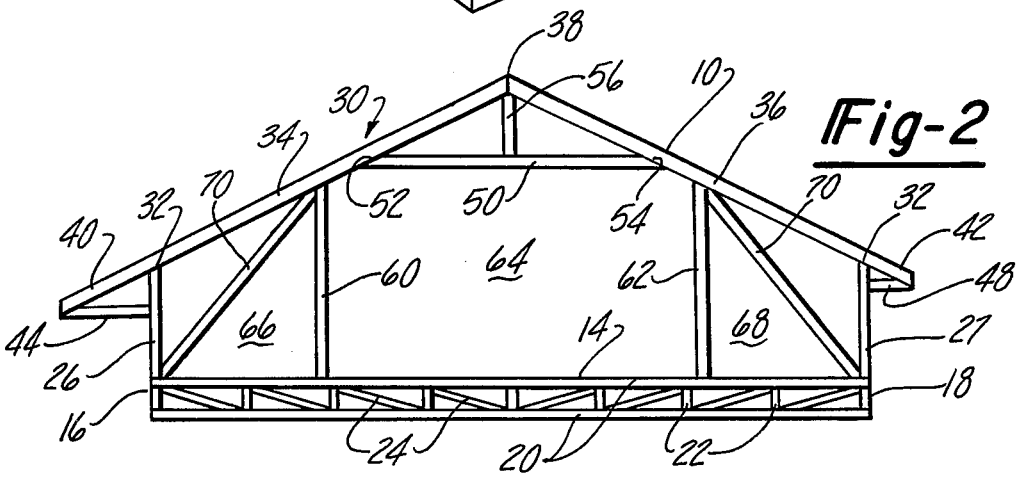
FIG. 2 is a side view illustrating one truss of the truss system.

With reference now to FIG. 2, one truss 10 is thereshown in greater detail and comprises an elongated floor joist 14 having outer ends 16 and 18. In the preferred form of the invention, the floor joist 14 is constructed from a pair of elongated wooden studs 20. The studs 20 are spaced and parallel with respect to each other while a plurality of perpendicular cross braces 22 are secured in between the studs 20 at spaced locations. In addition, a diagonal cross brace 24 extends between the studs 20 in between each pair of braces 22 so that the braces 22 and 24, together, enhance the rigidity and strength of the floor joist 14 while minimizing its cost. Other types of floor joists 14, however, can be used without deviation from the scope and spirit of the invention.

Still referring to FIG. 2, two elongated outer wall framing member or studs 26 and 27 are secured to front and rear ends 16 and 18, respectively, of the floor joist 14 so that the outer wall studs 26 and 27 extend perpendicularly upwardly from the floor joist 14 and are parallel to each other. The length of each outer wall framing member 26 and 27 is approximately one half the height of a conventional living space. Since the conventional living space is anywhere from 7–10 feet in height, the outer framing members 26 are approximately $3\frac{1}{2}$–5 feet long.

A peaked roof support 30 extends across and is secured to the upper ends 32 of the outer wall studs 26 and 27. The roof support 30 is preferably constructed from two wooden studs or joists 34 and 36 which are joined together to form a raised peak 38 positioned above the center line of the floor joists 14. The joists 34 and 36 decline downwardly from the peak 38 and extend outwardly from the outer wall studs 26 and 27 to form a front eave 40 and rear eave 42. A horizontal brace 44 is secured between the free edge of the front roof joist 34 and the front outer wall stud 26 while, similarly, a horizontal brace 48 extends between the free edge of the rear roof joist 36 and the rear outer wall stud 27.

Still referring to FIG. 2, a ceiling stud 50 is secured at one end 52 to the front roof joist 34 and at its other end 54 to the rear roof joist 36. The ceiling stud 50 is centered with the roof peak 38 and intersects the roof joists 38 and 36 at a point intermediate the ends of the roof support 30. In addition, the ceiling stud 50 is substantially parallel to the floor joist 14 and is spaced upwardly from the floor joist 14 by the height of a conventional living space. A vertical brace 56 between the roof support 30 at its peak 38 and the ceiling stud 50 enhances the rigidity of the ceiling.

Still referring to FIG. 2, an inner wall framing member or stud 60 extends between and is secured to the floor joist 14 and roof stud 34 at a position spaced inwardly from the front wall outer stud 26. Similarly, a second inner wall stud 62 extends between the floor joist 14 and rear roof stud 36 at a position spaced inwardly from the rear outer wall stud 27. Both the front and rear inner wall studs 60 and 62 extend perpendicularly upwardly from the floor joist 14 and are thus substantially parallel to each other. Furthermore, the upper end of these studs 60 and 62 intersect the roof support 30 at a position spaced slightly outwardly from the ends of the ceiling stud 50.

As will become hereinafter more clearly apparent, the space 64 between the inner wall studs 60 and 62 and ceiling member 50 constitutes a livable space of conventional height for the upper level of the home or building, once completed. Conversely, the area 66 between the front inner and outer wall studs 26 and 60, respectively, as well as the area 68 between the rear inner and outer wall studs 27 and 62, respectively, has a height less than a conventional living space. A diagonal cross brace 70 is preferably secured between the floor joist 14 and roof support 30 within these nonlivable spaces 66 and 68 to increase the rigidity and strength of the truss.

Figure 4:
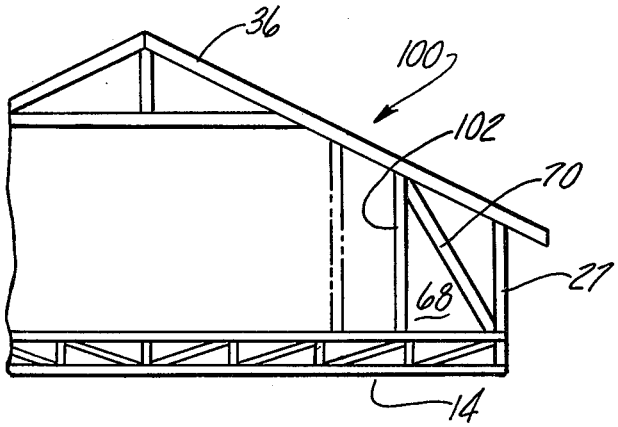
FIG. 4 is a fragmentary view similar to FIG. 2 but showing a modification thereof.

With reference now to FIG. 4, a second truss 100 is thereshown which is also used in constructing the frame for the upper level of the dwelling. The modified truss 100 is substantially the same as the truss 10 shown in FIG. 2 except that the rear inner wall stud 62 is instead replaced by a shorter inner wall stud 102 which is positioned closer to the rear outer wall stud 27 than in the first described truss 10. Thus, the nonlivable space 68 between the outer and inner wall studs 27 and 102 is much narrower than before. In addition, since the spacing between the studs 102 and 27 is less than the spacing between the studs 62 and 27 (FIG. 2) the diagonal braces 70 extending diagonally through the nonlivable space 68 has also been shortened.

Figure 5:
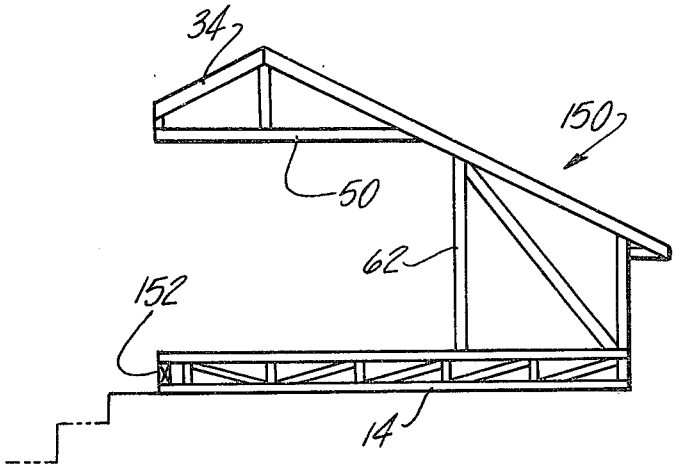
FIG. 5 is a fragmentary view similar to FIG. 2 but showing still a further modification thereof.

With reference now to FIG. 5, a third truss 150 is thereshown which is substantially identical to the truss shown in FIG. 2 except that the floor joist 14 is truncated at a position 152 short of the front outer wall stud 26. Similarly, the front stud 34 of the roof support 30 is also truncated at a position in line with the truncated end 152 of the floor joist 118. As will become shortly apparent, the truncated floor joist 14 shown in FIG. 5, provides an access to the living area 61 through a stairwell.

Figure 3:
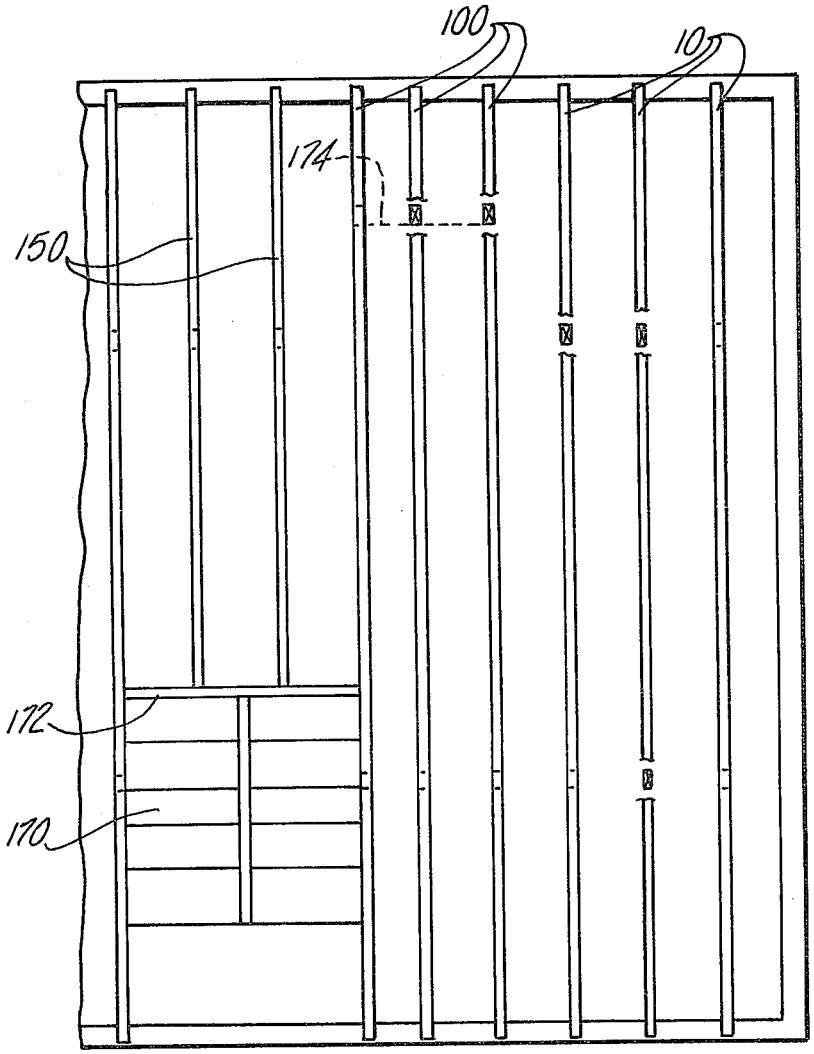
FIG. 3 is a top view of a preferred embodiment of the truss system.

With reference now to FIGS. 1 and 3, the trusses 10, 100 and 150 are positioned on the foundation walls 12 so that the foundation walls 12 engage and support the outer ends of the floor joists 14. Simultaneously, the trusses 10, 100 and 150 are spaced apart and aligned with each other and so that the trusses 10, 100 and 15 lie in substantially parallel planes.

As is best shown in FIG. 3, the third trusses 150, i.e., the trusses with the truncated floor joists, are positioned adjacent each other thus forming an open area for a stairwell 170. The truncated ends 152 of the floor joists 114 are also secured together by headers 172.

Similarly, the second trusses 100 are also mounted adjacent each other and thus form the frame for a recessed wall 174. The recessed wall 174 can be used for the back wall of a closet or the like. In addition, in order to facilitate the assembly of the trusses 10, 100 and 150 on the foundation walls 12, preferably these trusses are color coded to distinguish and differentiate between the three different trusses.

All three trusses 10, 100 and 150 are prefabricated in a factory and then shipped in assembled form to the building site. In this fashion, the trusses can be rapidly and easily assembled upon the foundation walls 12 to form the entire frame for the upper level of the building. In other words, once the trusses have been secured to the foundation walls 12, the frame work for the entire upper level, including all interior walls, ceiling, roof and floor, is simultaneously in place thus completely elimiating the need for carpenters to individually cut and assemble wooden studs to form the interior walls of the upper level. The only on side carpentry required is to complete the roof joists and front wall above the stairwell.

Having described my invention, however, many modifications thereto will become apparent to those skilled in the art to which it pertains without deviation from the spirit of the invention as defined by the scope of the appended claims.

I claim:

1. A truss system for constructing the frame for an upper level of a dwelling comprising:

a plurality of preassembled planar and rigid trusses, said trusses being spaced apart and lying in substantially parallel planes, at least two adjacent trusses of said plurality of trusses being substantially identical to each other, said at least two adjacent trusses each comprising:

an elongated floor joist, said joist comprising a pair of elongated spaced and parallel floor studs and a plurality of cross braces extending between and secured to said floor studs, a pair of elongated outer wall framing members, each outer wall framing member secured at one end to opposite ends of the floor framing members so that said outer wall framing members are spaced apart and parallel to each other, each outer wall framing member having a length equal to substantially one half of the height of a convential living space, a peaked roof support extending between and secured to the other ends of the outer wall framing members a horizontally extending ceiling stud secured to said roof support at a position intermediate the ends of the roof support and so that said ceiling stud is spaced upwardly from the floor joist by an amount equal to the height of a conventional living space, said ceiling stud forming a frame for a subsequent horizontal extending ceiling wall partition, and a first and second vertically extending inner wall studs, said inner wall studs having one end secured to said floor joist and their other ends secured to said roof support at a position spaced inwardly from one outer wall framing member so that said other end of said first inner wall stud intersects said roof support at a position closely adjacent to one end of said ceiling stud and so that said other end of said second inner wall stud intersects said roof support at a position closely adjacent to the other end of said ceiling stud, said inner wall studs forming a frame for subsequent vertically extending wall partitions, said inner wall studs, said ceiling stud and said floor joists together forming a substantially rectangular area having a height equal to the height of a conventional living space.

2. The invention as defined in claim 1 and comprising a diagonal cross brace extending between each inner wall stud and its adjacent outer wall framing member.

3. The invention as defined in claim 1 wherein the inner wall stud on a predetermined number of adjacent trusses is spaced from its adjacent outer wall member by an amount less than the other trusses.

4. The invention as defined in claim 1 wherein said cross braces comprise a plurality of spaced first braces extending substantially perpendicularly between said floor studs and a diagonal brace extending between the floor studs between each pair of first braces.

* * * * *

UNITED STATES PATENT AND TRADEMARK OFFICE

CERTIFICATE OF CORRECTION

PATENT NO. : 4,437,273

DATED : March 20, 1984

INVENTOR(S) : Robert Helfman

It is certified that error appears in the above—identified patent and that said Letters Patent is hereby corrected as shown below:

Column 4, line 44 delete "15" insert --150--.

Column 4, line 68 delete "elimiating" insert --eliminating--.

Signed and Sealed this

*Fourth* Day of *September 1984*

[SEAL]

*Attest:*

GERALD J. MOSSINGHOFF

*Attesting Officer*

*Commissioner of Patents and Trademarks*